US006135631A

United States Patent [19]

Keller

[11] Patent Number: 6,135,631

[45] Date of Patent: Oct. 24, 2000

[54] MIXER FOR MULTIPLE COMPONENT DISPENSING CARTRIDGE

[76] Inventor: Wilhelm A. Keller, Obstgartenweg 9, CH-6402 Merlischachen, Switzerland

[21] Appl. No.: 09/099,403

[22] Filed: Jun. 18, 1998

[30] Foreign Application Priority Data

Jun. 18, 1997 [EP] European Pat. Off. ..... 97810383

[51] Int. Cl.[7] ..... B67D 5/60; B01F 5/06

[52] U.S. Cl. ..... 366/339; 366/336; 222/145.6

[58] Field of Search ..... 366/336, 338, 366/339, 189; 222/145.6, 145.5

[56] References Cited

U.S. PATENT DOCUMENTS

| | | | |
|---|---|---|---|
| 4,771,919 | 9/1988 | Ernst | 222/134 |
| 4,846,373 | 7/1989 | Penn et al. | 222/137 |
| 5,249,709 | 10/1993 | Duckworth et al. | 222/137 |
| 5,487,606 | 1/1996 | Keller . | |
| 5,498,078 | 3/1996 | Keller . | |

FOREIGN PATENT DOCUMENTS

| | | |
|---|---|---|
| 319135 | 6/1989 | European Pat. Off. . |
| 444247 | 9/1991 | European Pat. Off. . |
| 0472448 A2 | 2/1992 | European Pat. Off. . |

*Primary Examiner*—W. L. Walker

*Assistant Examiner*—Terry K. Cecil

*Attorney, Agent, or Firm*—Foley & Lardner

[57] ABSTRACT

A mixer for a multi-component dispensing cartridge having at least two storage cylinders. The mixer includes an inlet section (4) and a mixer housing (2) having a mixer element group (3). The inlet section includes side by side separate inlets (4A, 4B) that terminate at an end plate (20) and which are adapted to connect with the storage cylinders. The mixer housing includes an internal face (21) that is parallel with the top surface (19) of the end plate to define a merging chamber (23) therebetween. The components flow from the inlets in a direction parallel to the top surface of the end plate forcing them to premix within the merging chamber before reaching the dividing edge (8) of the first mixer element. The merging chamber can also include a separating ridge (17) dividing the inlet openings (20A, 20B) and a U-shaped baffle (16). The a U-shaped baffle has arms that open towards the smaller inlet opening (20B) and a partial blocking means (18) on top of the baffle for forcing the component flowing out the larger inlet opening (20A) to flow toward the smaller inlet opening and into the open arms of the U-shaped baffle before reaching the dividing edge. This mixer ensures an effective merging of the components before reaching the first mixer element so that the number of mixer elements and the required dispensing force can be reduced. Also, the storage cylinders can have a volumetric ratio other than 1:1.

3 Claims, 4 Drawing Sheets

MIXER FOR MULTIPLE COMPONENT DISPENSING CARTRIDGE

BACKGROUND OF THE INVENTION

The present invention refers to a mixer for a multiple component dispensing cartridge or dispensing appliance, having at least two storage cylinders and comprising a mixer housing containing a mixer element group and being attachable to the dispensing cartridge or appliance, and an inlet section comprising side by side separate inlets communicating with the dividing edge of the first element of the mixer element group. Such mixers are known and they have the function of intimately mixing the components in order to prepare them for their application. For the sake of clarity, two components are mentioned only in the following description, but it is evident that there can be more than two components. The dividing edge is the first edge where the united material streams are first divided for being mixed together.

In the cartridge/mixer assemblies of the prior art, two or more material streams flow from the outlets of the cartridge to the dividing edge of the first mixer element of the mixer element group for subsequent thorough mixing. However, there is a problem of presenting the components in an optimal manner to the first dividing edge of the mixer element group depending upon the volumetric ratio of the components and their viscosities.

With mixing ratios higher than 1:1, e.g. 10:1, there is a likelihood that the larger component fills up part of the length of the mixer element group of the mixer at the beginning of the dispensing process and that the second component, having a smaller volume, is thus suppressed or subdued. In the inlet area in particular, the larger partial flow "A" will press the smaller partial flow "B" against the wall of the mixing tube on the "B" side where it is held back by wall friction and therefore subdued or suppressed by the larger "A" component. Thus the mixing process can only begin with some difficulty and delay. In this initial phase, the partial flow "A" precedes and a proper mixture cannot be achieved in the correct volumetric ratio. Thus the components cannot properly react with each other, resulting in defective bonds, seals, joints, impressions, etc. Since the "B" component is generally a hardener or catalyst, a mixture with an insufficient amount of "B" component is useless, and, because of this in order to stabilize the desired proportions of the components, it is common practice to dispense and discard a certain quantity of material before being able to start the proper application of the mixture. Besides waste of material, the initially dispensed material may not harden and may additionally cause disposal problems. If used, however, it may cause end product failure.

In U.S. Pat. No. 5,487,606 of the same applicant, a solution to this problem is suggested by first retaining the larger "A" component in a chamber and by providing means for directing it to the inlet chamber of the second "B" component for carrying the latter along. Although this embodiment provided an improvement with respect to the then state of the art, it results in an increased flow resistance due to several necessary restrictions of the cross-sectional area which requires higher dispensing forces and may possibly make reinforcement of the cartridge walls necessary.

In the mixer according to U.S. Pat. No. 5,498,078 of the same applicant, the intimate mixing of the components has been improved yet further over the then existing prior art. Also in this disclosure, as in the aforementioned, the components are brought together substantially in the direction of the longitudinal axis of the mixer.

SUMMARY OF THE INVENTION

Based upon this background, it is an object of the present invention to provide a mixer in which the components leaving the cartridge, or dispensing device, via two separated side by side outlets, are guided within the inlet portion of the mixer such that the components flow against the dividing edge so as to ensure optimum conditions at the beginning of the mixer element group, thus avoiding out of ratio mixture and enabling the use of a minimum number of mixer elements. This object is attained by a mixer wherein the inlet section ends with an end plate having inlet openings for the components to flow through, and wherein between the top surface of the end plate and the mixer housing, a space is formed for forcing the components to flow substantially perpendicular to the longitudinal mixer axis and parallel to the top surface of the end plate towards a dividing edge, the inlet openings being arranged on both sides and in line with the dividing edge.

BRIEF DESCRIPTION OF THE DRAWINGS

The invention will be explained in more detail hereinafter with reference to the following drawings of an embodiment.

DETAILED DESCRIPTION OF THE INVENTION

Figure 1:
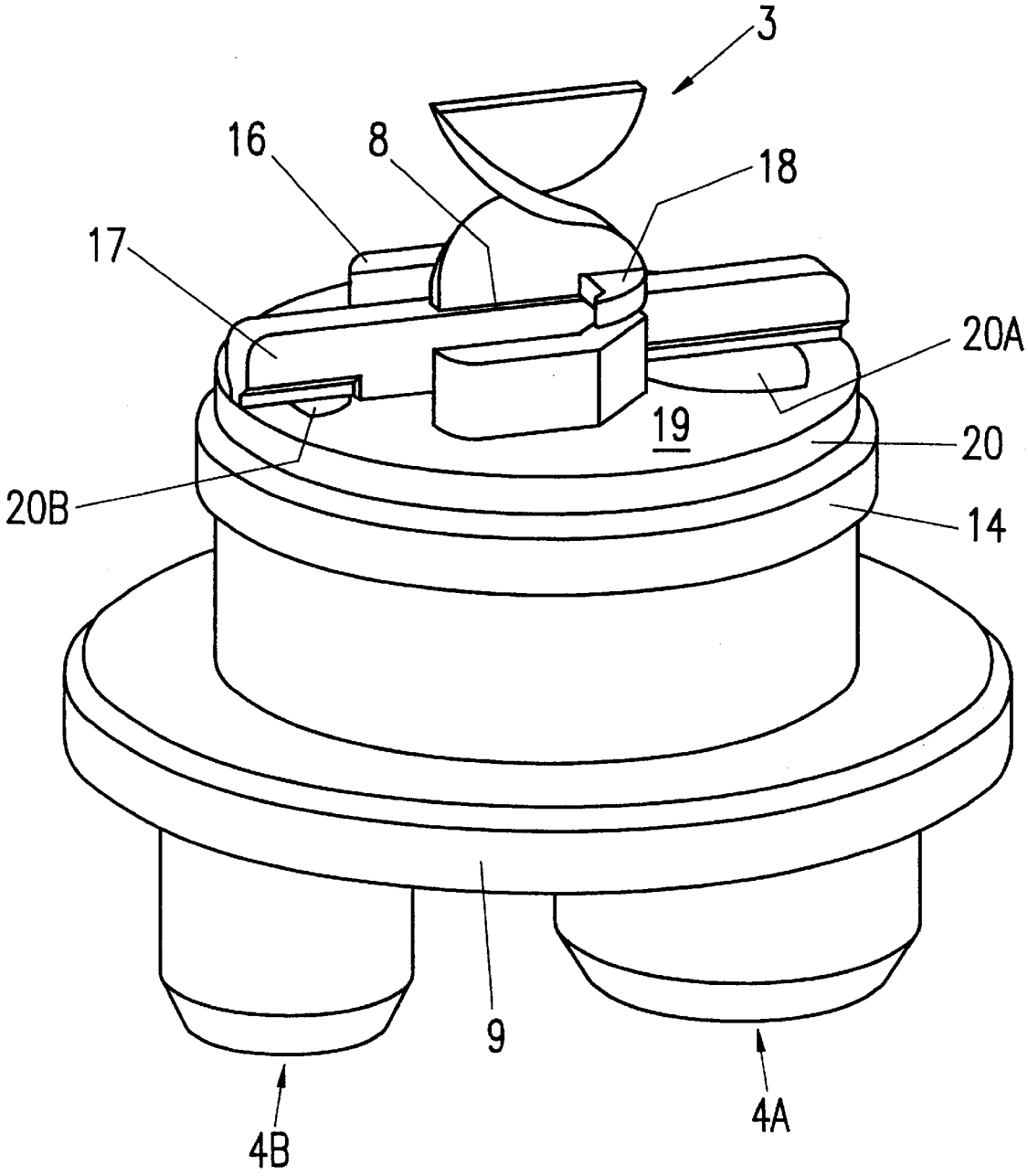
FIG. 1 shows in a perspective view the inlet portion of a mixer according to the invention.

FIG. 1 shows in a perspective view the inlet portion of a mixer according to the invention, the mixer elements and other parts of the device will be explained with the aid of FIGS. 2 to 5. In the embodiment shown, the components have a ratio which differs from 1:1, and the larger component "A" flows out of the divided inlet opening 20A around baffle 16 to the second divided inlet opening 20B and merges with, and carries with it, the smaller component "B" coming out of divided inlet opening 20B, both streams arriving at both sides of the dividing edge 8 of the first mixer element of the mixer element group 3.

In the description of the embodiment, the dividing edge is the dividing edge of the first mixer element of the mixer element group. However, the dividing edge can also be a short dividing wall either attached to a separating ridge or to the first mixer element or to both.

Figure 2:
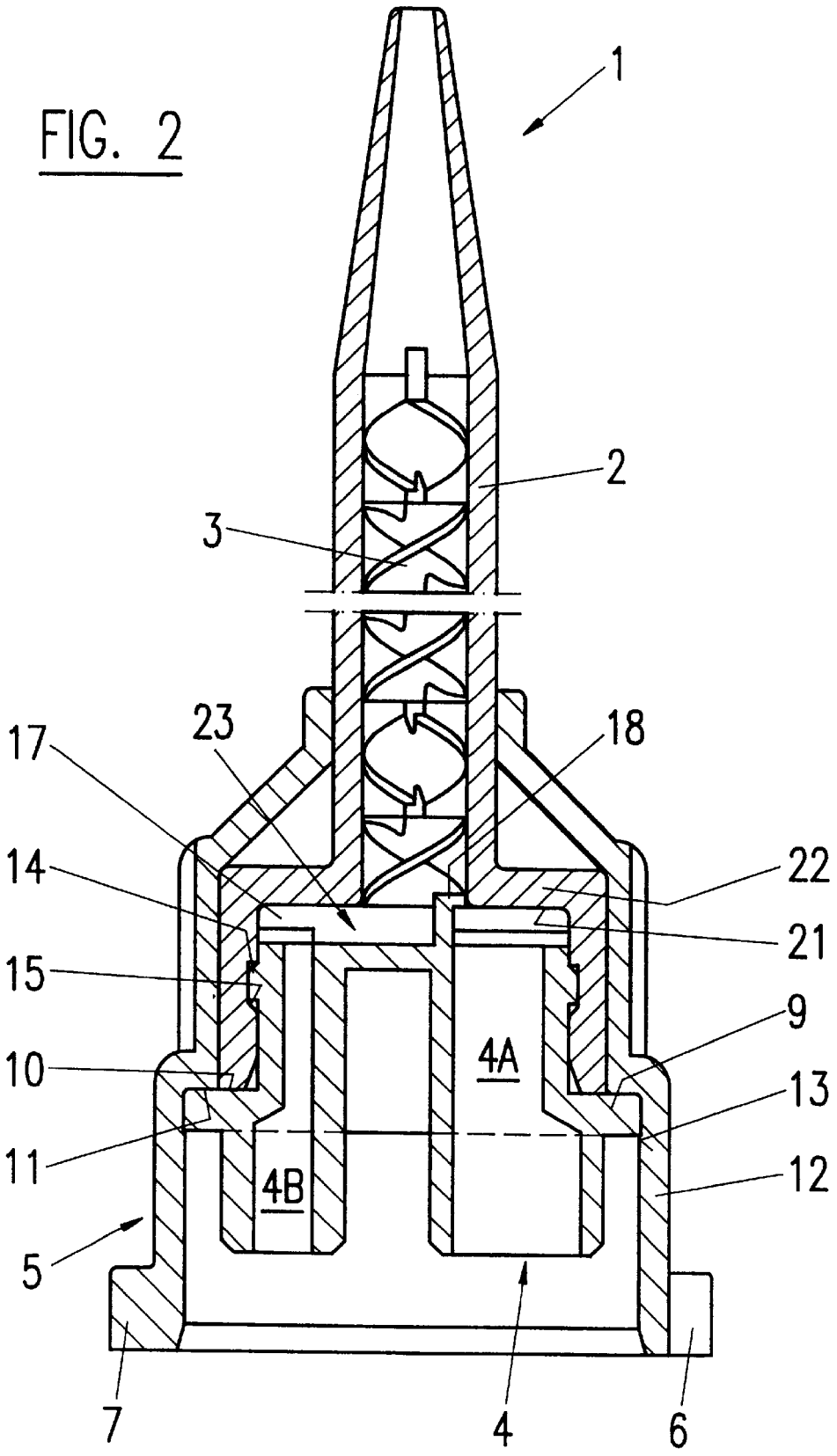
FIG. 2 shows in a longitudinal section the mixer of FIG. 1.

FIG. 2 shows a mixer 1 comprising a mixer housing 2 containing a mixer element group 3 consisting of helical mixer elements, an inlet section 4 and a coupling ring 5 for fastening the mixer to a two component cartridge with bayonet fastening means 6 and 7.

Figure 3:
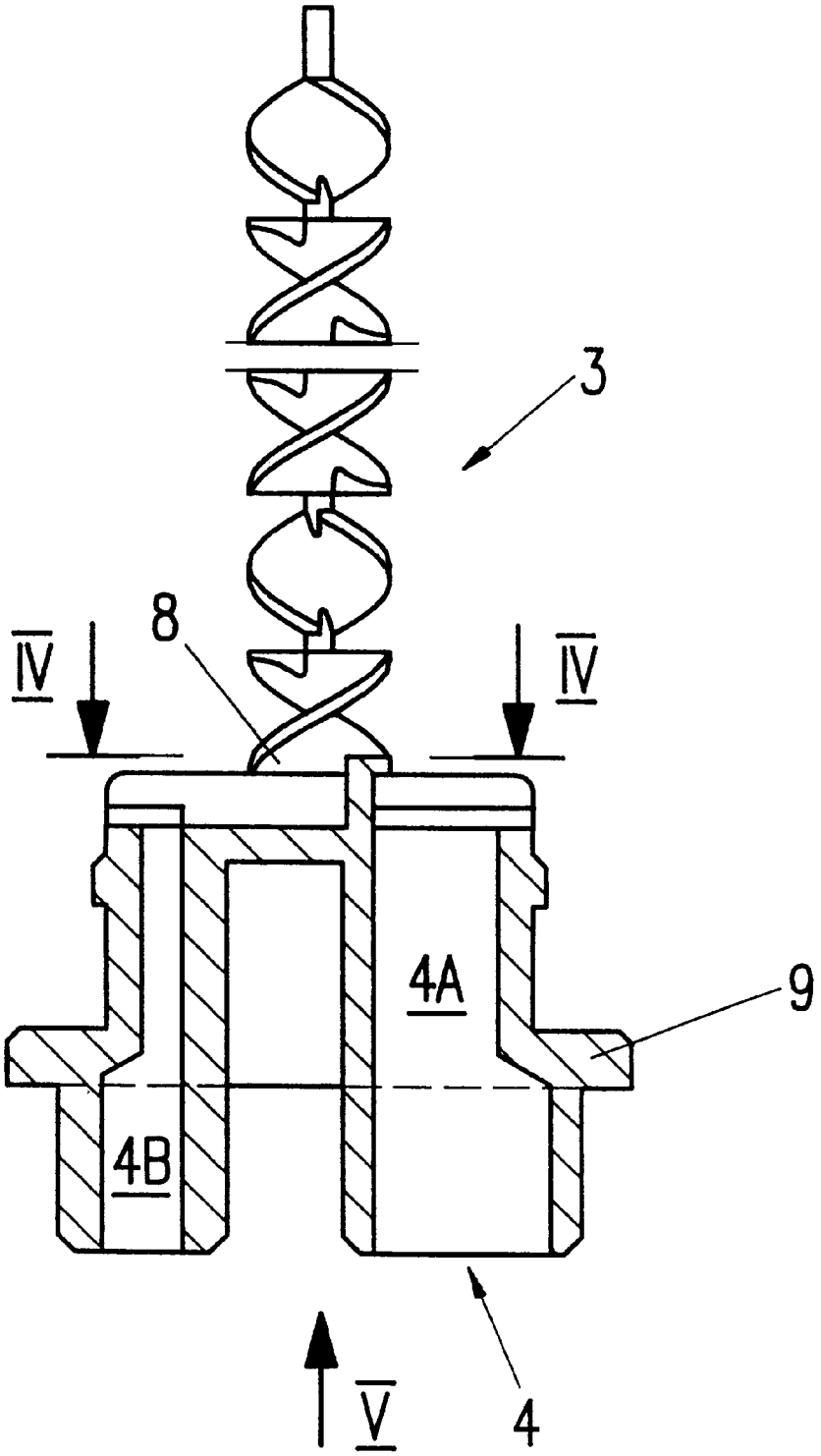
FIG. 3 shows in a cross section according to line III—III of FIG. 4 a detail of FIG. 2.

As best shown in FIG. 3 the inlet section 4 comprises an inlet 4A for a larger component "A" and a smaller inlet 4B for a smaller component "B". Both components arrive at the dividing edge 8 of the first mixer element of the mixer element group 3. The inlet section 4 comprises further a flange 9, the upper side of which is directed towards the mixer element group and fits against the inlet end 10 of the mixer housing 2 and an inner shoulder 11 of the wall 12 of the coupling ring.

Below the shoulder 11 of the coupling ring is a shallow groove 13 for holding flange 9. The outer diameter of the inlet section 4 further comprises a retaining flange 14 held in a groove 15 in the mixer housing.

Figure 4:
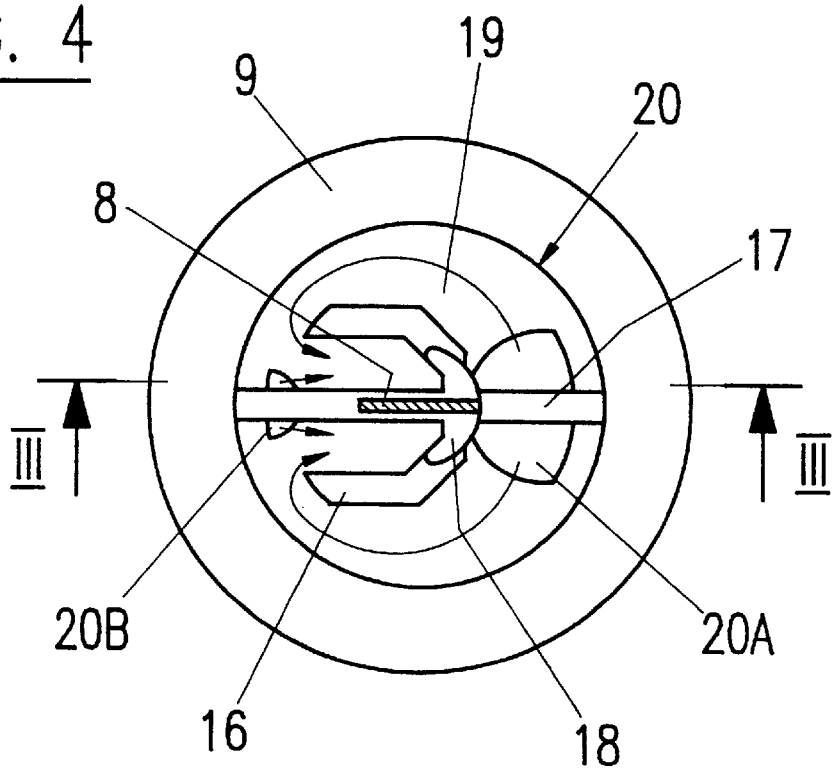
FIG. 4 shows a cross-section according to line IV—IV in FIG. 3.
Figure 5:
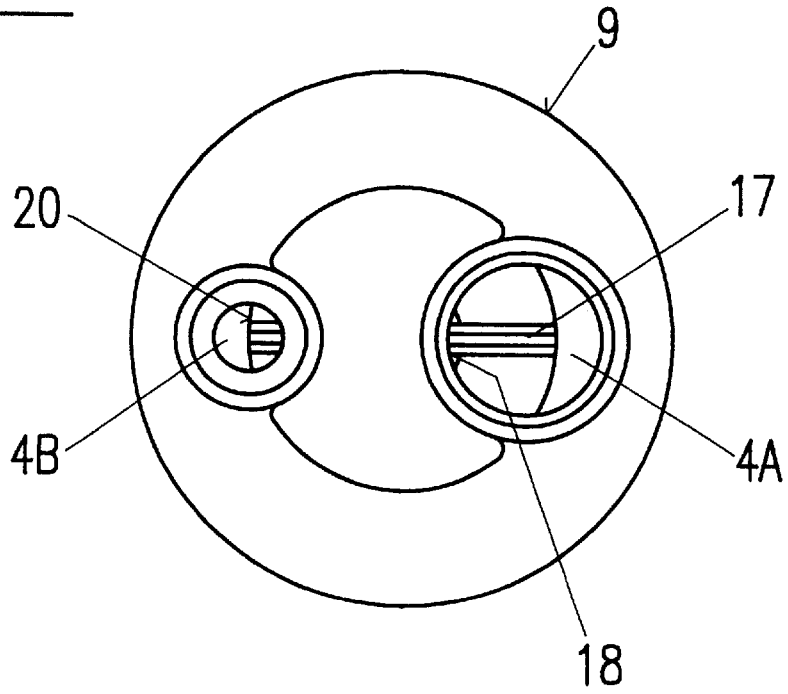
FIG. 5 shows a view in direction of the arrow V in FIG. 3.

FIG. 4 shows a main feature of the invention whereby both components are forced, on both sides of separating ridge 17, to flow along the surface 19 formed by the top of the end plate 20 which closes off the merging chamber 23 at the inlet side. In the case of FIGS. 1 and 5, which show two components with a ratio differing from 1:1, the larger component "A" flows out of larger inlet 4A through divided inlet opening 20A and is directed towards the divided inlet opening 20B of smaller inlet 4B for the smaller component "B". This occurs, in an indirect way, on both sides of the separating ridge 17 around the arms of a U-shaped baffle 16 and back within the open baffle arms, carrying with it the second component "B" towards the dividing edge 8 of the first mixer element.

As further shown in FIG. 4, there is a separating ridge 17 across the surface 19 of the end plate 20 in line with the dividing edge 8 of the first mixer element, the separating ridge 17 having the same height as the baffle. A blocking means 18 is located on top of the baffle, partially closing off the cross section of the housing 2 of the mixer element group for preventing component "A" from flowing directly to the dividing edge of the first mixer element. As shown in FIG. 1, the profile of the separating ridge 17 is in the area of the divided inlet openings, and tapered toward the bottom for better flow separation of the material.

It follows from FIG. 2 that the mixer housing encloses the top surface 19 of the inlet section at the periphery by the internal face 21 of a step 22 in the wall of the mixer housing at the level of the top of the baffle and separating ridge, thus forming a space in the form of merging chamber 23 so that the components are forced to follow the prescribed path parallel to the top surface and perpendicular to the flow direction of the material which leads to the dividing edge 8 of the first mixer element of the mixer element group 3 within the mixer housing.

Although the above description refers to an embodiment where the components have a ratio which is differing from 1:1 the invention may also be applied to embodiments for components having a ratio of 1:1. The above ensures an effective merging of the components before reaching the first mixer element so that a reduction of the number of mixer elements can be achieved, thus resulting in a reduced dispensing force compared to prior art mixers obtaining the same result.

I claim:

1. A mixer for a multiple component dispensing appliance having at least two storage cylinders, said mixer comprising:

a mixer housing; and an inlet section, the inlet section having side by side separate inlets terminating at an end plate and adapted to be connected to the at least two storage cylinders;

the end plate having a top surface and a bottom surface and inlet openings for the components from the separate inlets to flow therethrough, the mixer housing communicating with the inlet section and containing a mixer element group comprising a plurality of elements, the plurality of elements including a first mixer element having a dividing edge, the dividing edge arranged parallel with the top surface and having a first end and a second end, the side by side separate inlets arranged in line with the dividing edge, one each at the first and second ends and on the bottom surface of the end plate, and the mixer housing having an internal face that is parallel with and faces the top surface of the end plate to define a merging chamber therebetween for forcing the components to pre-mix within the chamber and to flow in a direction substantially perpendicular to a longitudinal axis of the mixer and parallel to the top surface of the end plate towards the dividing edge as the components flow through the inlet openings in the end plate.

2. A mixer according to claim 1, wherein the merging chamber contains means for deflecting and guiding the flow of the components and a separating ridge arranged across the top surface of the end plate, the separating ridge dividing the inlet openings for the components, the separating ridge being aligned with the dividing edge.

3. A mixer according to claim 2, wherein the at least two storage cylinders have a volumetric ratio other than 1:1, the side by side separate inlets and the inlet openings have a different size, and the deflecting and guiding means comprises a U-shaped baffle having arms that open towards a smaller one of the inlet openings and a partial blocking means on top of the baffle for forcing the component flowing out of a larger one of the inlet openings to flow toward the smaller inlet opening and into the open arms of the U-shaped baffle before reaching the dividing edge, the component flowing out of the larger inlet opening carrying the component flowing out of the smaller inlet opening.

* * * * *